US007941930B2

(12) United States Patent
Guip

(10) Patent No.: US 7,941,930 B2
(45) Date of Patent: May 17, 2011

(54) HAND-HELD POWER TOOL

(75) Inventor: Andreas Guip, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 12/627,280

(22) Filed: Nov. 30, 2009

(65) Prior Publication Data

US 2010/0071925 A1 Mar. 25, 2010

Related U.S. Application Data

(62) Division of application No. 11/538,472, filed on Oct. 4, 2006, now abandoned.

(30) Foreign Application Priority Data

Oct. 6, 2005 (DE) ..... 10 2005 047 882

(51) Int. Cl.
*B27B 17/02* (2006.01)

(52) U.S. Cl. ..... 30/523; 30/381; 30/520; 403/329; 411/175; 173/162.2

(58) Field of Classification Search ..... 30/166.3, 30/235, 276, 380, 381, 388, 513, 517, 518, 30/520, 522–524; 16/406, 409–411, 413, 16/416, 422, 425, 426, 436–438, 443, 444; 24/460–462; 403/326, 329; 411/174, 175; 173/162.2

See application file for complete search history.

(56) References Cited

U.S. PATENT DOCUMENTS

| | | | | |
|---|---|---|---|---|
| 2,672,905 | A * | 3/1954 | Hartman et al. | 411/175 |
| 2,781,073 | A * | 2/1957 | Trafton | 411/107 |
| 3,358,729 | A * | 12/1967 | Munse | 411/175 |
| 3,414,035 | A * | 12/1968 | Munse | 411/175 |
| 4,141,143 | A * | 2/1979 | Hirschkoff et al. | 30/381 |
| 4,296,553 | A * | 10/1981 | Dirks et al. | 30/381 |
| 4,684,305 | A * | 8/1987 | Dubost | 411/174 |
| 5,039,264 | A * | 8/1991 | Benn | 411/175 |
| 5,306,091 | A * | 4/1994 | Zaydel et al. | 411/175 |
| 6,287,064 | B1 * | 9/2001 | Jhumra et al. | 411/175 |
| 6,553,619 | B2 * | 4/2003 | Chen | 16/114.1 |
| 6,799,373 | B2 * | 10/2004 | Menzel et al. | 30/381 |
| 6,994,068 | B2 * | 2/2006 | Menzel et al. | 123/192.1 |

* cited by examiner

*Primary Examiner* — Boyer D. Ashley
*Assistant Examiner* — Edward Landrum
(74) *Attorney, Agent, or Firm* — Gudrun E. Huckett

(57) ABSTRACT

A hand-held power tool has a motor housing with drive motor and a grip housing with a longitudinal support and a forward grip. The motor housing and the grip housing are connected to one another by antivibration elements. The forward grip has a connecting end that is connected by a screw connection to the longitudinal support. The screw connection has at least one fastening screw that is positioned in the operating position of the power tool in a vertical direction of the power tool. The screw connection has a metal insertion part that is positioned entirely within the contour of the longitudinal support that is a plastic part. The metal insertion part has a screw receptacle for the at least one fastening screw. The at least one fastening screw is fixedly screwed into the metal insertion part.

9 Claims, 6 Drawing Sheets

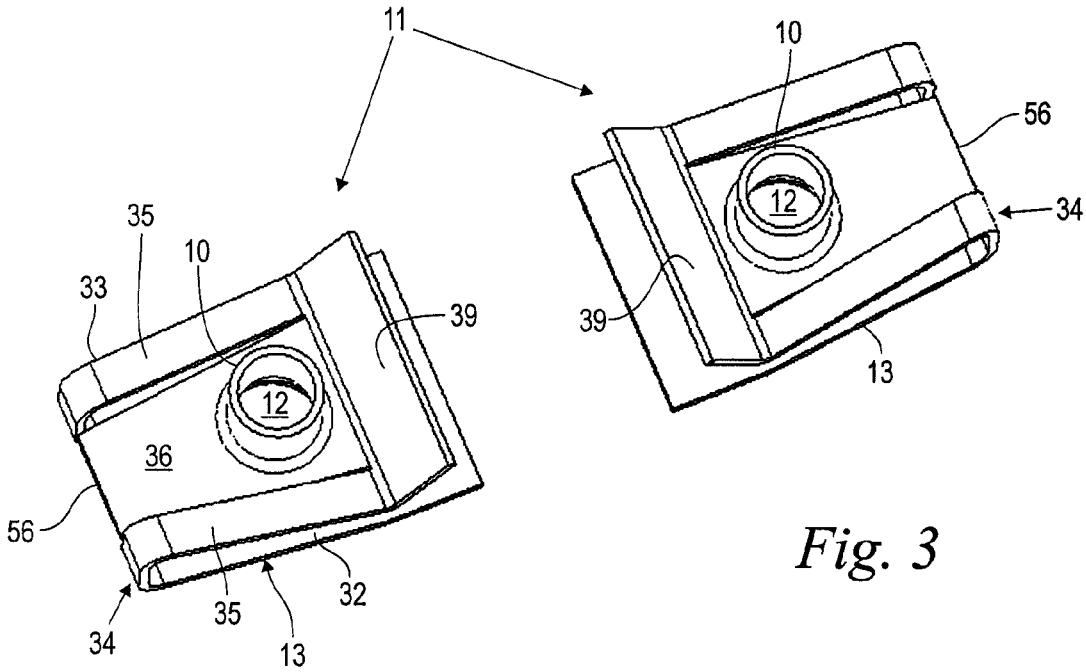
Fig. 3
Fig. 4
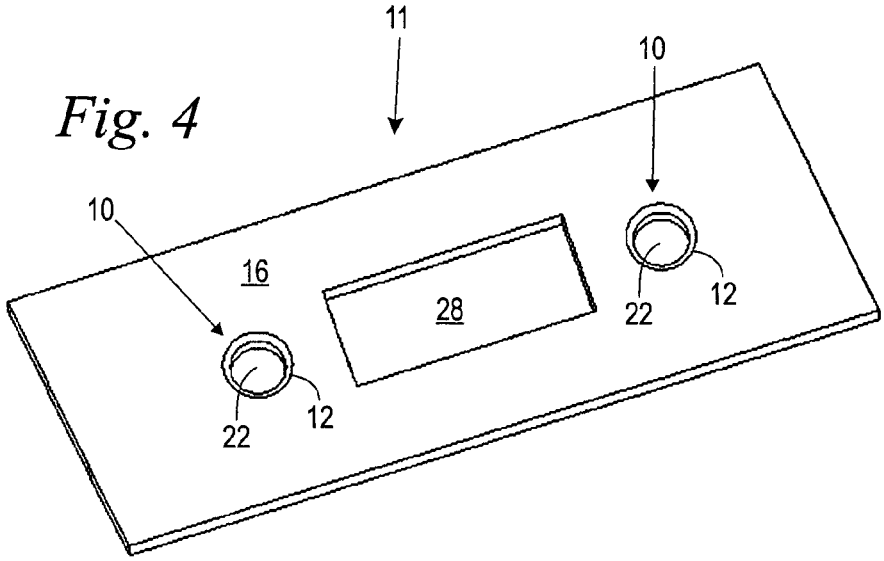

HAND-HELD POWER TOOL

This application is a divisional of application Ser. No. 11/538,472 having a filing date of Oct. 4, 2006 the disclosure of which is incorporated by reference in its entirety. This application claims foreign priority benefits under 35 USC 119 of German patent application DE 10 2005 047 882.4 having a filing date of Oct. 6, 2005 the disclosure of which is incorporated by reference in its entirety.

BACKGROUND OF THE INVENTION

The invention relates to a hand-held power tool such as a chainsaw, a hedge trimmer or the like, comprising a motor housing as well as a grip housing with a longitudinal support wherein the grip housing and the motor housing are connected to one another by antivibration elements. When looking at the power tool in the usual working position, a forward grip pipe is fixedly connected by a screw connection in the area of an connecting end to the longitudinal support of the grip housing, wherein at least one fastening screw of the connecting end is arranged at least approximately in a vertical direction of the power tool.

Hand-held power tools such as chainsaws, hedge trimmers or the like are held and guided in operation by the operator by means of several grips. Using a chainsaw of a known configuration as an example, in the usual working or operating position a rear grip facing the operator and a forward grip facing the saw chain are provided for supporting, carrying and guiding the chainsaw.

In operation, the drive motor and the cutting tool generate vibrations that must be kept away from the grips. For this purpose, a two-part configuration with a motor housing and a separate grip housing is provided wherein the grip housing and the motor housing are connected to one another by means of antivibration elements. The rear grip and the forward grip pipe are connected to the grip housing and decoupled from the motor housing in regard to vibrations by means of the antivibration elements.

In order to provide an ergonomic gripping in different grip positions, the forward grip pipe extends in an arc shape about the motor housing and is attached with a lower connecting end to a longitudinal support at the bottom of the grip housing. With regard to the size of the motor housing and in particular the total height of the power tool, the longitudinal support has only a minimal height. The grip pipe is also flattened in the area of the lower connecting end and is fixedly screwed from below to the longitudinal support of the grip housing.

In a widely used configuration two fastening screws pass with their longitudinal axis extending in a vertical direction through the connecting end of the grip pipe and are screwed by self-tapping action from below in the upward direction into plastic screw receptacles of the longitudinal support. For a satisfactory load capacity of this screw connection, an appropriate screwing depth must be provided. This screwing depth determines the thickness of the longitudinal support in the area of the screw connection and adds to the cross-sectional thickness of the grip pipe in this area. In addition to the aforementioned total height, a vertical gap between the longitudinal support and the motor housing must also be taken into account; this gap enables an elastic vibrational movement of the comparatively rigid assembly comprised of grip housing and grip pipe relative to the motor housing. The space for this is limited. In particular, an oil tank, for example, for oil for lubricating the chain, is often provided in this area, and the tank itself requires an appropriate space. In the desired compact configuration, in particular, compact in the vertical direction, this may lead to the thick longitudinal support of the grip housing coming into contact with the motor housing in the area of the screw receptacles as a result of a vibration-caused movement; this leads to cancellation of the vibration-decoupling action of the antivibration elements.

SUMMARY OF THE INVENTION

It is an object of the present invention to configure a hand-held power tool of the aforementioned kind in such a way that a highly loadable connection of the grip pipe and the longitudinal support of the grip housing is possible at reduced size.

In accordance with the present invention, this is achieved in that the fastening screw is fixedly screwed into a screw receptacle of a metal insertion part wherein the insertion part is received in the longitudinal support made from plastic material so as to be located entirely within the contour of the longitudinal support.

The metal insertion part requires only a minimal height as a result of the selected material (metal) in order to securely hold a fastening screw to be screwed into the insertion part. By means of the arrangement within the contour of the longitudinal support, the height of the insertion part does not add to the height of the longitudinal support. The longitudinal support can be constructed with regard to its thickness or its height solely based on requirements with regard to bending resistance so that a flat cross-section is made possible. While taking into consideration a sufficiently large free gap relative to the motor housing, a compact configuration can be achieved.

The screw receptacle of the insertion part can be a spring bracket or a soft sheet metal part into which the self-tapping thread of the fastening screw can be screwed. However, a ready-made thread can also be provided. In a preferred configuration, the screw receptacle is a threaded bore for receiving particularly a metric outer thread of the fastening screw. In addition to a high load capacity and a compact configuration, a simple assembly requiring only minimal screwing forces is enabled.

In an advantageous configuration, the insertion part is a thin sheet metal part with a sleeve-shaped screw receptacle formed as a unitary part. The sheet metal part can be produced as a monolithic stamped part or monolithic folded part; it is lightweight and space-saving. The monolithic formed sleeve-shaped screw receptacle provides space for a suitable number of turns of the thread; this provides a safe receiving action of the fastening screws even when it is screwed in and removed several times.

The insertion part is expediently a spring bracket, in particular made of spring steel, wherein the spring bracket has two spring legs that engage by clamping an inner mounting rib of the longitudinal support. Mounting is easy by simply inserting the spring bracket. In the screwed state, the spring legs are pressed against both sides of the mounting rib and are therefore fixedly secured so as not to slide. Advantageously, the connecting end of the grip pipe rests flat on one of the two spring legs and the opposite spring leg supports the screw receptacle. The spring leg adjoining the connecting end of the grip pipe serves as an intermediate layer between the connecting end and the mounting rib made from plastic so that the mounting rib is relieved of excessively high local surface pressures.

In an advantageous further configuration, the spring bracket is bent to a U-shape thus providing the two spring legs. A bottom section of the U-shape connecting the spring legs is wider than the thickness of the mounting rib; the two spring legs, beginning at the bottom section, converge toward one another. This configuration avoids a local clamping action in the area of the bottom section and displaces the clamping action into the area of the free ends of the spring legs where they have a sufficiently large elastic spring travel. Thickness tolerances of the mounting rib can therefore be compensated easily.

The spring leg supporting the screw receptacle is expediently made from two spring strips between which a contact section with the screw receptacle is provided; the contact section has independent spring action and is approximately parallel to the opposed spring leg. While maintaining the elastic spring travel in the area of the free end of the spring legs, the contact section and the parallel extending, opposed spring leg rest flat against the opposed sides of the mounting rib. The flat contact generates a high load capacity with minimal surface pressures.

At least one of the two spring legs has expediently a widening mounting ramp that simplifies manual or even automatic threading of the spring bracket onto the mounting rib. Each fastening screw of the connecting end has advantageously correlated therewith a separate spring bracket. The spring brackets can be produced in large numbers as a standard component and can be used in power tools having various configurations of screw connections.

In an expedient alternative, the metal insertion part is a thick, plane insertion sheet metal plate with a through bore provided as a screw receptacle. In particular, the insertion sheet metal plate has two screw receptacles for one fastening screw each. The insertion sheet metal plate can be produced in a simple way without requiring forming steps. When providing an appropriate thickness of the insertion sheet metal plate, the through bore has a suitable depth for a sufficient number of thread turns without added material thickness being required in this area. By arranging two screw receptacles in one insertion sheet metal plate, their spacing and position relative to one another are predetermined. Additional measures for positional adjustment in the longitudinal support of the grip housing are not required. For the purpose of weight reduction, the arrangement of a cutout between the two screw receptacles can be expedient.

Advantageously, the insertion sheet metal plate is secured in particular by a clamping action in a pocket-shaped receptacle of the longitudinal support. For this purpose, the pocket-shaped receptacle has expediently at least one clamping rib. For assembly, only a simple insertion of the insertion sheet metal part into the pocket-shaped receptacle is required. In the receptacle, the sheet metal plate is reliably secured in its position by means of the clamping rib until the subsequent positional fixation is realized by means of the screw connection connecting the end of the grip pipe and the longitudinal support.

BRIEF DESCRIPTION OF THE DRAWING

FIG. 3 shows a first embodiment of two insertion parts in the form of spring brackets.

FIG. 4 is a further embodiment of the insertion part in the form of an insertion sheet metal part with two through bores.

FIG. 8 shows the end of the longitudinal support according to FIGS. 6 and 7 with the connecting end of the grip pipe being screwed on.

DESCRIPTION OF THE PREFERRED EMBODIMENTS

Figure 1:
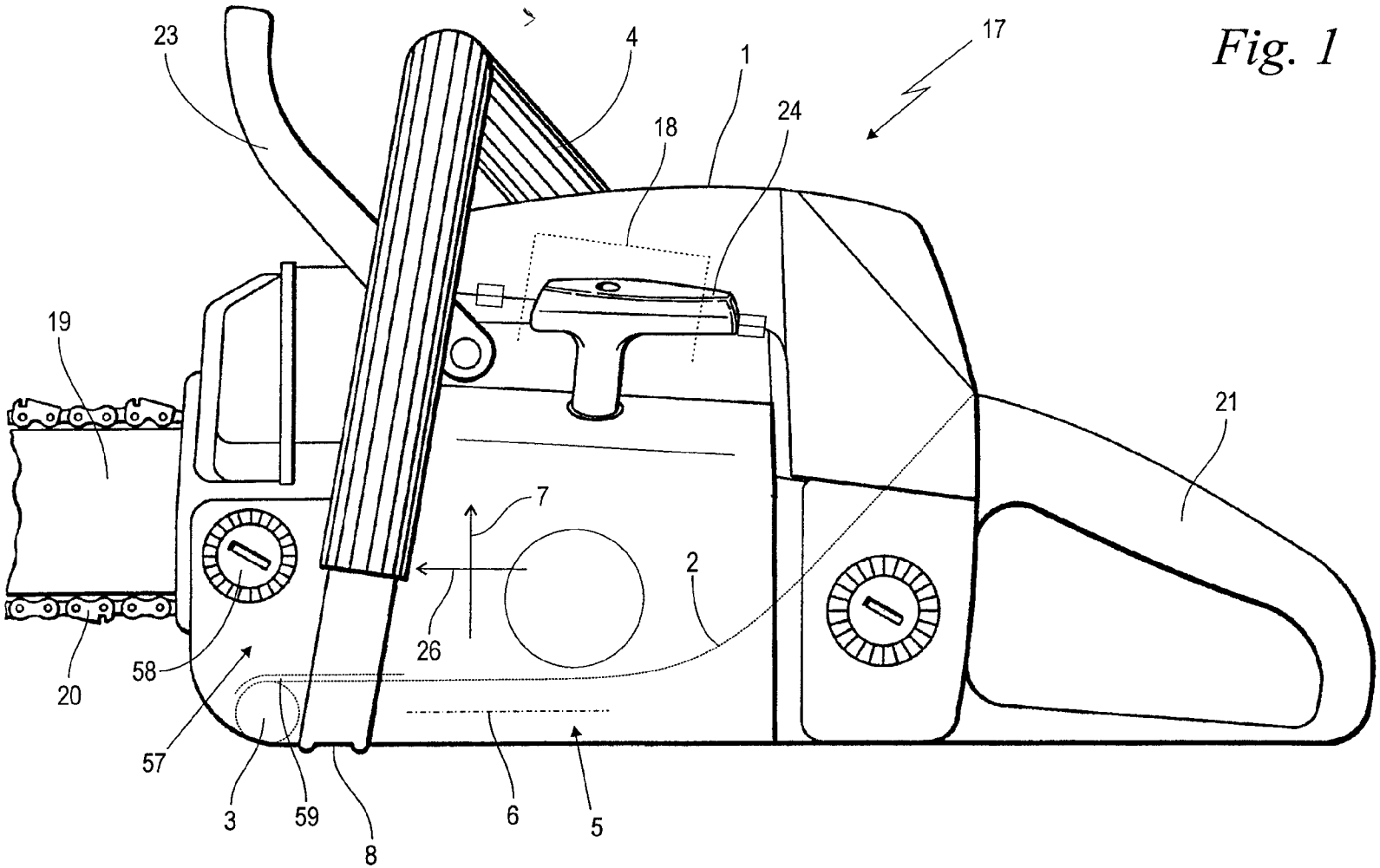
FIG. 1 shows in a side view a detail of a hand-held power tool exemplified by a motor chainsaw with a grip pipe attached to a grip housing.

The hand-held power tool 17 illustrated in FIG. 1 is exemplified by a chainsaw driven by an internal combustion engine 18 (not shown in detail). The power tool can also be a hedge trimmer or the like. Instead of the internal combustion engine 18 it is also possible to employ an electric motor as a drive motor. The internal combustion engine 18 is secured in the motor housing 1 and drives a saw chain 20 circulating about the guidebar 19 and shown only in part.

In the usual operating position of the power tool 17, there is a forward orientation facing away from the operator and indicated by arrow 26 in which the guidebar 19 with the saw chain 20 are positioned in front of the motor housing 1. On a grip housing 2 that is separate from the motor housing 1 a rear grip 21 is provided that, relative to the direction 26, is positioned to the rear of the power tool and behind the motor housing 1. A forward grip pipe 4 surrounding the motor housing 1 is attached to the forward area of the grip housing 2.

The motor housing 1 surrounds at a spacing approximately like a "U" a longitudinal support 5, shown in dashed lines, of the grip housing 2. A longitudinal axis 6 of the longitudinal support 5 extends approximately parallel to the forward direction 26. Relative to the illustrated usual operating position, an upward vertical direction is indicated by arrow 7. The longitudinal axis 6 of the longitudinal support 5 extends centrally through the bottom of the motor housing 1 relative to the arrows 26, 7 and a transverse direction extending transversely to the illustrated arrows 26, 7.

The grip housing 2 and the motor housing 1 are connected to one another by means of several antivibration elements 3 wherein, for simplifying the illustration, only one antivibration element 3 is indicated as an example. The illustrated antivibration element 3 is arranged in front of a connecting end 8 of the grip pipe 4 between the longitudinal support 5 and the motor housing 1. By means of the antivibration elements 3, the grip housing 2, considered as a substantially rigid unit together with the rear grip 21 formed thereon and the fixedly screwed-on grip pipe 4, is vibrationally decoupled from the motor housing 1.

Above the longitudinal support 5 in the area of the connecting end 8 and the antivibration elements 3 positioned in front thereof, an oil tank 57 is arranged in the motor housing 1; the tank 57 contains lubricating oil for the saw chain 20. A lid 58 closes off the filling socket that opens into the oil tank 57 for filling in lubricating oil. Above the longitudinal support 5 and also in the two lateral directions between the longitudinal support 5 and the motor housing 1 with oil tank 57, a vibration gap 59 is provided (indicated by dotted lines); the gap 59 enables a vibration-caused movement of the module comprising the grip housing 2 relative to the module comprising the motor housing 1. In the case of a minimal height in the vertical direction 7, a sufficiently large vibration gap 59 relative to the motor housing 1 in the area of the oil tank 57 is desirable, in particular in the area of the connecting end 8.

Between the forward grip pipe 4 and the guidebar 19, a lever 23 of a braking device for the saw chain is arranged; it is pivotably supported on the motor housing 1 and, as needed, is actuated by the operator's hand that grips the forward grip pipe 4. For starting the combustion engine 18, a cable pull starter 24 is provided.

Figure 2:
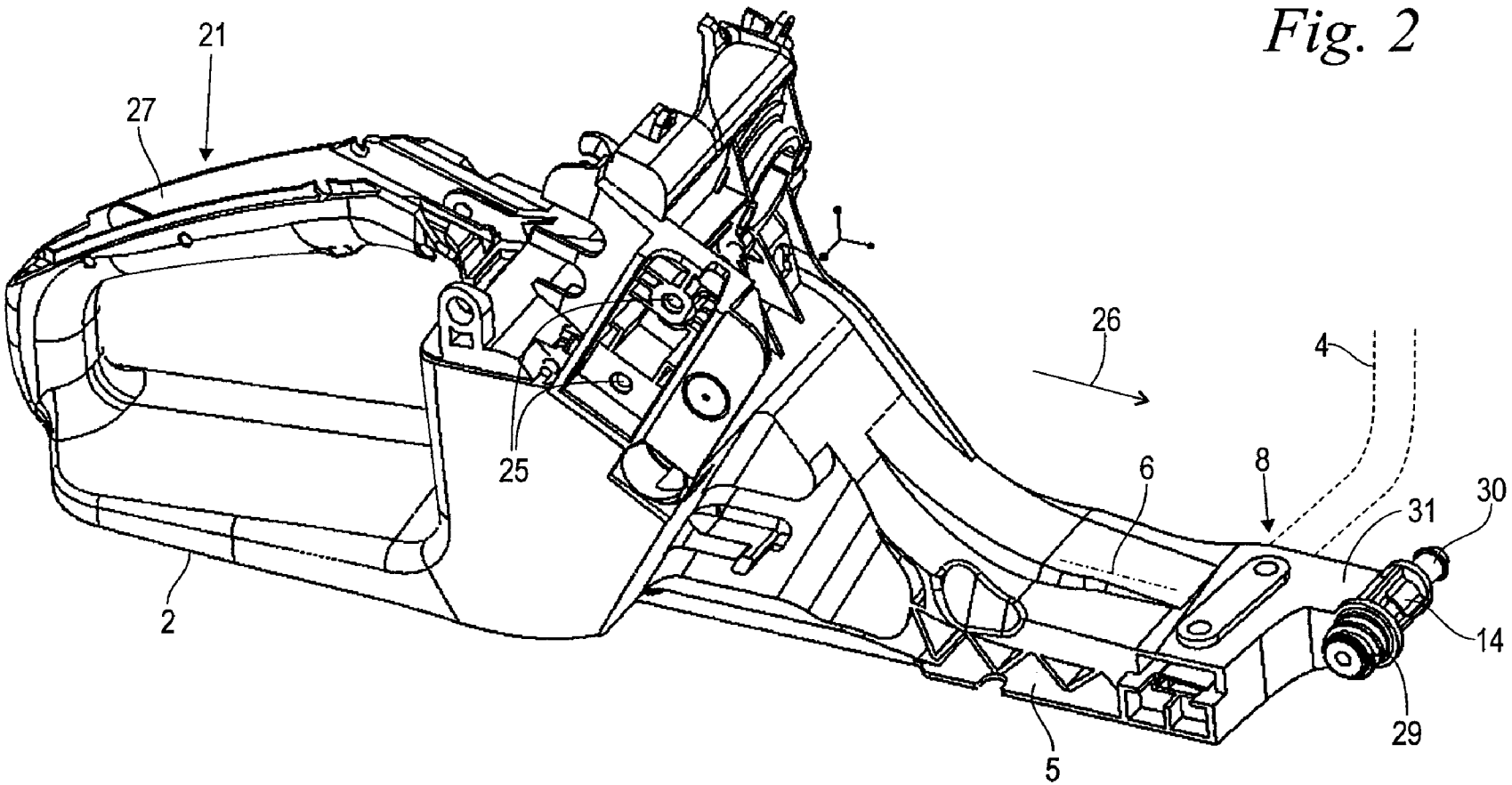
FIG. 2 is a perspective illustration of the grip housing according to FIG. 1 with the grip pipe, shown in dashed lines, screwed onto the longitudinal support of the grip housing provided at the bottom.

FIG. 2 shows a perspective view of the grip housing 2 according to FIG. 1. The grip housing 2 is configured as an injection molded plastic part; a housing section 27 for forming the rear grip 21 is formed thereon as a monolithic part. The grip pipe 4 illustrated in dashed lines is attached by means of the connecting end 8 to the forward end of the longitudinal support 5. Relative to the longitudinal axis 6 or the forward direction 26, a connecting point 14 for the antivibration element 3 illustrated in FIG. 1 adjoins the screw connection area of the connecting end 8. The connecting point 14 projects in the longitudinal direction 6 past the connecting end 8. For this purpose, the fastening point 14 is formed by means of an arm 31 extending in the direction of the longitudinal axis 6 as a monolithic part of the longitudinal support 5; the longitudinal support 5, in turn, is a monolithic part of the grip housing 2 that, as a whole, is formed as an injection molded plastic part. Relative to the forward direction 26 and the vertical direction 7, the connecting point 14 is provided at the right side with a threaded pin 29 and, at the opposite end, on the left side with a smooth pin 30. The threaded pin 29 serves for receiving a coil spring, not illustrated, while the smooth pin 30 is designed for receiving a rubber-elastic damping element (not illustrated). The coil spring and the damping element are attached opposite to one another on the motor housing 1 (FIG. 1) and form together the antivibration element 3 illustrated schematically in FIG. 1.

For screwing the grip pipe 4 to the grip housing 2 on the end (not illustrated) opposite the illustrated connecting end 8, the grip housing 2 is provided with two screw receptacles 25 that enable an overall rigid screw connection of the grip pipe 4 and the grip housing 2.

Figure 7:
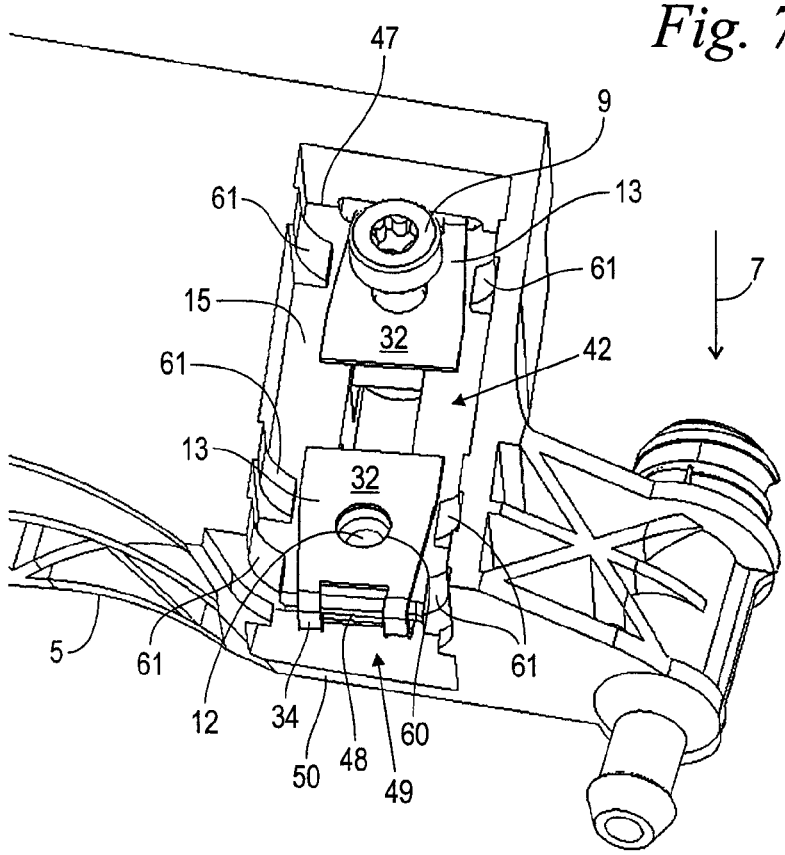
FIG. 7 shows the arrangement of FIG. 6 with spring brackets pushed in place.
Figure 8:
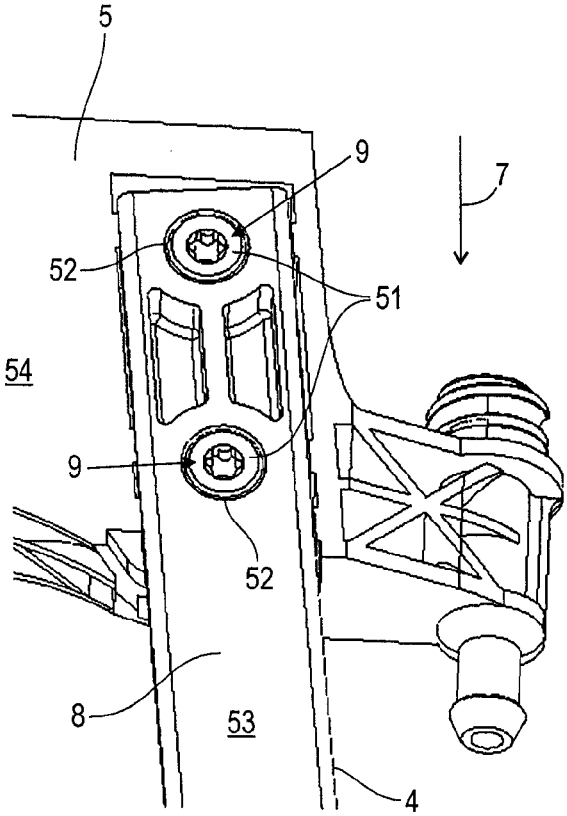

FIG. 3 shows in a perspective illustration a first embodiment of two metal insertion parts 11 that are provided for a fixed and non-yielding (inelastic) screw connection of the connecting end 8 and the longitudinal support 5 (FIG. 2). In the illustrated embodiment, a pair of separate identical insertion parts 11 is provided that, in accordance with the illustration of FIG. 8, enable receiving of two fastening screws 9. The insertion parts 11 each have a screw receptacle 10 that is configured as a threaded bore 12 for receiving a metric thread of the fastening screw 9 (FIGS. 7 and 8). The two insertion parts 11 are thin sheet metal parts, formed as a unitary part from spring steel by die-cutting, stamping, and folding, and are shaped as a spring bracket 13. The spring bracket 13 is bent to a U-shape thereby forming two spring legs 32, 33 wherein from a bottom section 34 of the U-shape the lower approximately plane or flat spring leg 32 projects. Opposite the spring leg 32, two spring strips 35 extend from the bottom section 34 in a fork shape and are positioned at a spacing relative to one another. At their ends opposite the bottom section 34, the strips 35 are connected by a transverse bar provided with an outwardly bent mounting ramp 39. Starting at the transverse bar, a unitary contact section 36 extends in the direction toward the bottom section 34 and ends with a free edge 56 that, like the two lateral edges of the contact section 36, are separated from the other components of the spring bracket 13. In this way, a spring action of the contact section 36 between the two spring strips 35 independent of the elastic deformation of the spring strips 35 is ensured.

The contact section 36 is essentially plane; however, a screw receptacle 10 in the form of a cylindrical sleeve projects out of the plane of the contact section 36 as a monolithic part and extends in the direction away from the spring leg 32. The sleeve is provided with an inner thread (not illustrated). The contact section 36 with its unitary sleeve-shaped screw receptacle 10, with the mounting ramp 39, and the two spring strips 35 forms the second spring leg 33 that, like the spring leg 32, projects from the bottom section 34. Together, the legs 32, 33 and the bottom section 34 provide the U-shape. The surface of the plane contact section 36 is positioned approximately parallel to the surface of the plane spring leg 32. Starting here, the mounting ramp 39 widens relative to the spring leg 32 into a V-shape in a direction oriented away from the bottom section 34.

The two spring brackets 13 are arranged relative to one another in the mounting position in such a way that the two mounting ramps 39 point toward one another while the two bottom sections 34 and the free edges 56 face away from one another.

FIG. 4 shows a perspective view of a further embodiment of the insertion part 11 which is configured as a thick, plane insertion sheet metal plate 16. At a defined spacing to one another, two through bores 22 are provided that pass through the height of the insertion sheet metal plate 16; the bores 22 are configured as threaded bores 12 and thus form the screw receptacles 10. The thickness (height) of the plane insertion sheet metal plate 16 is selected such that the predetermined depth of the threaded bores 12 provide a sufficient number of threaded turns in order to securely hold the fastening screws 9 illustrated in FIG. 7 and FIG. 8. It can also be expedient to provide the insertion sheet metal plate 16 in the area of the screw receptacles 10 with a sleeve-shaped formed part that is comparable to the configuration according to FIG. 3. Between the two screw receptacles 10, the insertion sheet metal plate 16 is provided with a cutout 28 for weight reduction purposes. It can also be advantageous to select for each screw receptacle 10 a separate insertion sheet metal plate 16.

Figure 5:
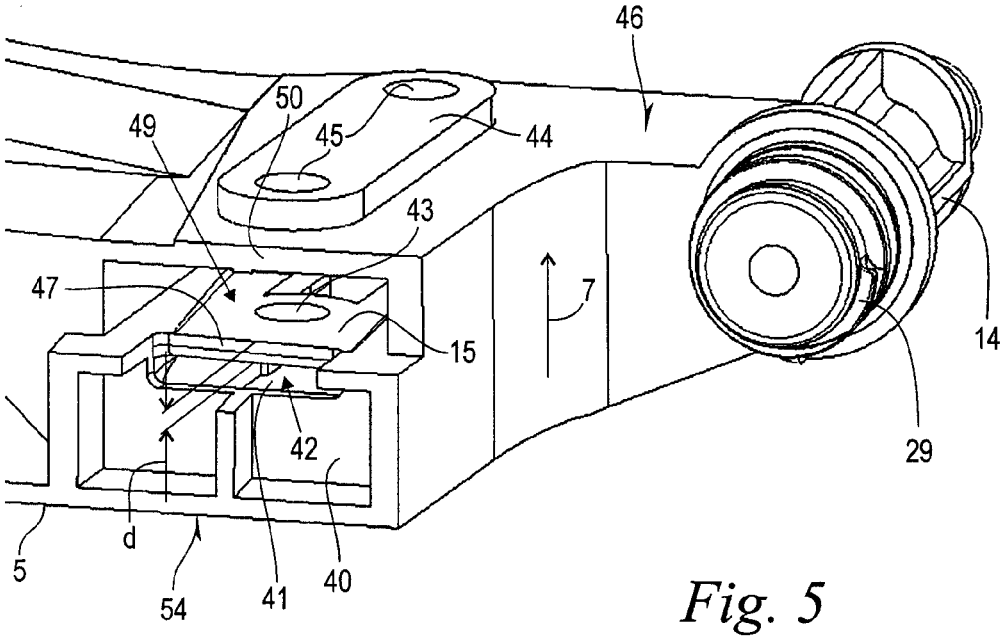
FIG. 5 shows an enlarged detail illustration of the front end of the longitudinal support of the grip housing according to FIG. 2 with details of a mounting rib for receiving the spring brackets according to FIG. 3.

FIG. 5 shows in a detail view the longitudinal support 5 according to FIG. 2 in the area of its free end. The longitudinal support 5 is configured for receiving the spring bracket 13 according to FIG. 3.

In FIG. 5, the right side of the longitudinal support 5 is shown when the power tool is in the usual operating position with upward vertical direction 7; this side has the threaded pin 29 of the connecting point 14. In the vertical direction 7 the longitudinal support 5 is delimited downwardly by plane bottom surface 54 and upwardly by the plane topside 46. For explaining the configuration according to the invention, on the topside 46 an added portion 44 with two holes 45 is shown that projects past the topside 46 and is not part of the present invention. In accordance with the prior art, it would be necessary for realizing a screw connection of the connecting end 8 and the longitudinal support 5 (FIG. 2) to provide the added portion 44 with the holes 45 so that self-tapping fastening screws can be received with satisfactory screw-in depth. This added portion 44 projects disruptively into the vibration gap 59 (FIG. 1). With the inventive configuration the added portion 44 (which has been shown in FIG. 5 only for illustration purposes) is not needed and is eliminated so that the topside 46 is now plane and essentially uninterrupted; there are essentially no projecting parts for the purpose of enabling a screw connection.

In the area of the grip pipe screw connection the topside 46 is formed by a closed supporting cover surface 50 below which an intermediate space 49 is provided. In the downward direction, the intermediate space 49 is delimited by a mounting rib 15 with two bores 43. In the illustration according to FIG. 5, only one of the two bores 43 is illustrated while both bores 43 are illustrated in FIG. 6.

In the lateral direction on the right side illustrated in FIG. 5, a closed wall 40 is provided that, beginning at the plane bottom surface 54, extends in the vertical direction 7 approximately to a lateral edge 47 of the mounting rib 15. However, near the lateral edge 47, between it and the wall 40, there is a slot 41 which forms a passage into the grip receptacle 42 that is illustrated in more detail in FIG. 6. For forming the slot 41, the upper edge of the wall 40, relative to the vertical direction 7, is positioned at a spacing below the edge 47 of the mounting rib 15.

The mounting rib 15 is essentially plane and has a constant thickness or height d. With reference to FIG. 3, the illustrated spring brackets 13 are matched to the thickness d of the mounting rib 15 in such a way that the spacing of the two spring legs 32, 33 relative to one another in the area of the mounting ramp 39 in the elastically springy, unloaded state is smaller than the thickness d. The height of the opening between the two springs strips 35 of the spring leg 33 and the oppositely positioned spring leg 32 in the area of the bottom section 34 is however greater than the thickness d. Also, the two free end face edges of the two spring legs 32, 33 have in the area of the mounting ramp 39 a spacing relative to one another that is greater than the thickness d. This enables an elastic springy, clamping action when pushing the spring bracket 13 by means of the mounting ramp 39 onto the edge 47 and also onto the oppositely positioned edge 48 (illustrated in FIG. 6); this causes the two spring legs 32, 33 to be spread apart. In the mounted state the spring leg 33 and the contact section 36 of the spring leg 32 rest flat against the topside and the bottom side of the mounting rib 15, respectively. The threaded bore 12 is positioned congruently on one of the two bores 43, respectively. Further details result from the description of FIGS. 7 and 8 that is to follow.

Figure 6:
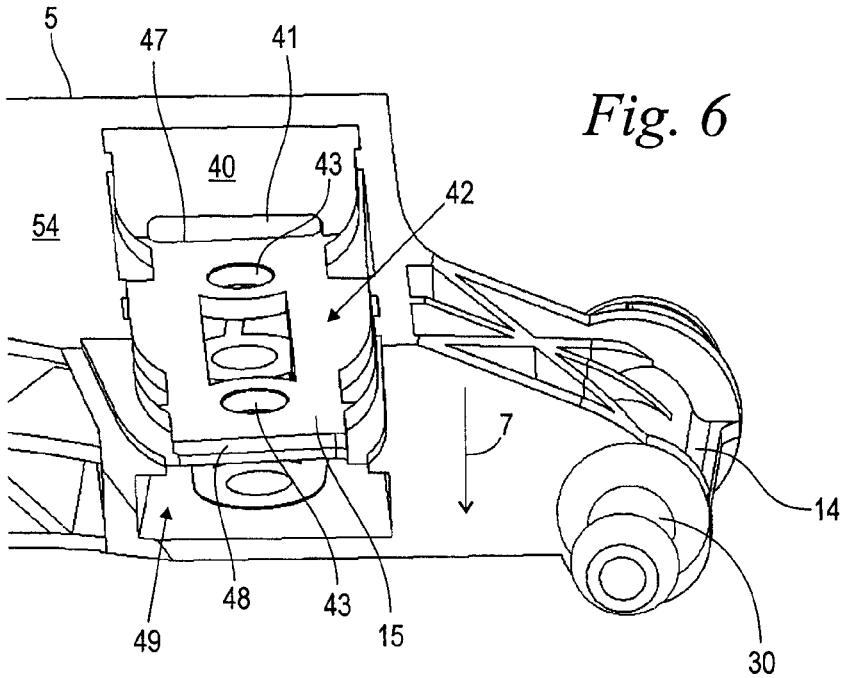
FIG. 6 is a perspective illustration of the arrangement of FIG. 5 in a bottom view in the area of the opposite side showing details of the mounting rib and the grip receptacle adjoining in the downward direction.

FIG. 6 shows the arrangement of FIG. 5 in the rotated state: the vertical direction 7 is extending downwardly in the illustration and the left side of the longitudinal support 5 is shown in this illustration at a slant from below. The smooth pin 30 of the connecting point 14 is facing the viewer. It can be seen that beginning at the plane bottom surface 54 of the longitudinal support 5 in the vertical direction 7 and in the transverse direction, not identified, a tub-shaped grip receptacle 42 is provided that is open in the direction of the plane bottom surface 54 and is delimited in the vertical direction 7 by the mounting rib 15 and in the lateral direction by the wall 40. In the opposite lateral direction facing the viewer the grip receptacle 42 is open. The illustration of the slot 41 shows that one spring bracket 13 according to FIG. 3 can be inserted through the slot 41 past the edge 47 in the transverse direction onto the mounting rib 15. When looking at both FIGS. 5 and 6, it can also be seen that the intermediate space 49 is open in both lateral directions so that a spring bracket 13 according to FIG. 3 can be pushed in the afore described way also onto the edge 48 that is located opposite the edge 47.

The aforementioned arrangement with mounted spring brackets 13 is illustrated in FIG. 7. It is shown that the two spring brackets 13 have been pushed so far onto the mounting rib 15 that the bottom sections 34 rest against correlated edges 47, 48 the lateral direction. The spring legs 32 rest flat on the mounting rib 15 and are positioned freely accessible in the grip receptacle 42. The spring legs 32 are each provided with a circular opening 60. In the mounted state, the circular openings 60 are positioned, together with the threaded bores 12, in alignment and axially congruent to the bores 43 shown in FIG. 6. The two spring legs 33 together with the threaded bores 12 illustrated in FIG. 3 are positioned opposite the illustrated spring legs 32 within the intermediate space 49 and are covered in the vertical direction 7 by the cover surface 50. Accordingly, the spring brackets 13 relative to the vertical direction 7 are positioned completely within the contour of the longitudinal support 5 delimited by the bottom surface 54 and the cover surface 50. The two edges 47, 48 of the mounting rib 15 are displaced inwardly in the lateral direction, relative to the lateral surfaces of the longitudinal support 5, such that the bottom sections 34 relative to the lateral direction are located within the aforementioned lateral surfaces. Accordingly, the spring brackets 13 are completely located within the contour of the longitudinal support 5 even in the lateral direction.

For demonstration purposes, a fastening screw 9 (FIG. 7) is illustrated in an exemplary fashion; it is a metric screw having an M5 outer thread and is inserted through opening 60 and the bore 43 (FIG. 6) and screwed into the threaded bore 12.

FIG. 8 shows the arrangement according to FIG. 7 in completely mounted state. Referring at the same time to FIG. 7, it can be seen that a total of two spring brackets 13 for a total of two fastening screws 9 are provided. In this way, each fastening screw 9 of the connecting end 8 of the grip pipe 4 has correlated therewith a separate spring bracket 13. It can also be expedient to provide a different number of fastening screws 9 and spring brackets 13. The connecting end 8 of the grip pipe 4 is at least approximately received without play in the grip receptacle 42. The connecting end 8 is in direct contact and in particular rests flat against the ribs 61 of the grip receptacle 42 and against the spring legs 32. The connecting end 8 is provided with a flat bottom 53 that is flush with the plane bottom surface 54 of the longitudinal support 5. Moreover, the connecting end 8 is provided with two recesses 52 that each receive completely a screw head 51 of the fastening screw 9 so that the screw head 51 in the vertical direction 7 does not project past the flat bottom 53. Relative to the vertical direction 7, the height of the module comprised of longitudinal support 5 and grip pipe 4 is substantially determined in the area of the connecting end 8 exclusively by the vertical spacing between the plane bottom surface 54 and the topside 46 shown in FIG. 5.

When the fastening screws 9 are screwed in and tightened in the threaded bores 12, their screw heads 51 force the connecting end 8 against the spring leg 32 which, in turn, is pressed against the mounting rib 15. At the opposite side, the spring leg 33 shown in FIG. 3 is pressed by the threaded bore 12 in the opposite direction against the topside of the mounting rib 15 so that, as a whole, a rigid screw connection of the connecting end 8 and the mounting rib 15 of the longitudinal support 5 is realized.

Figure 9:
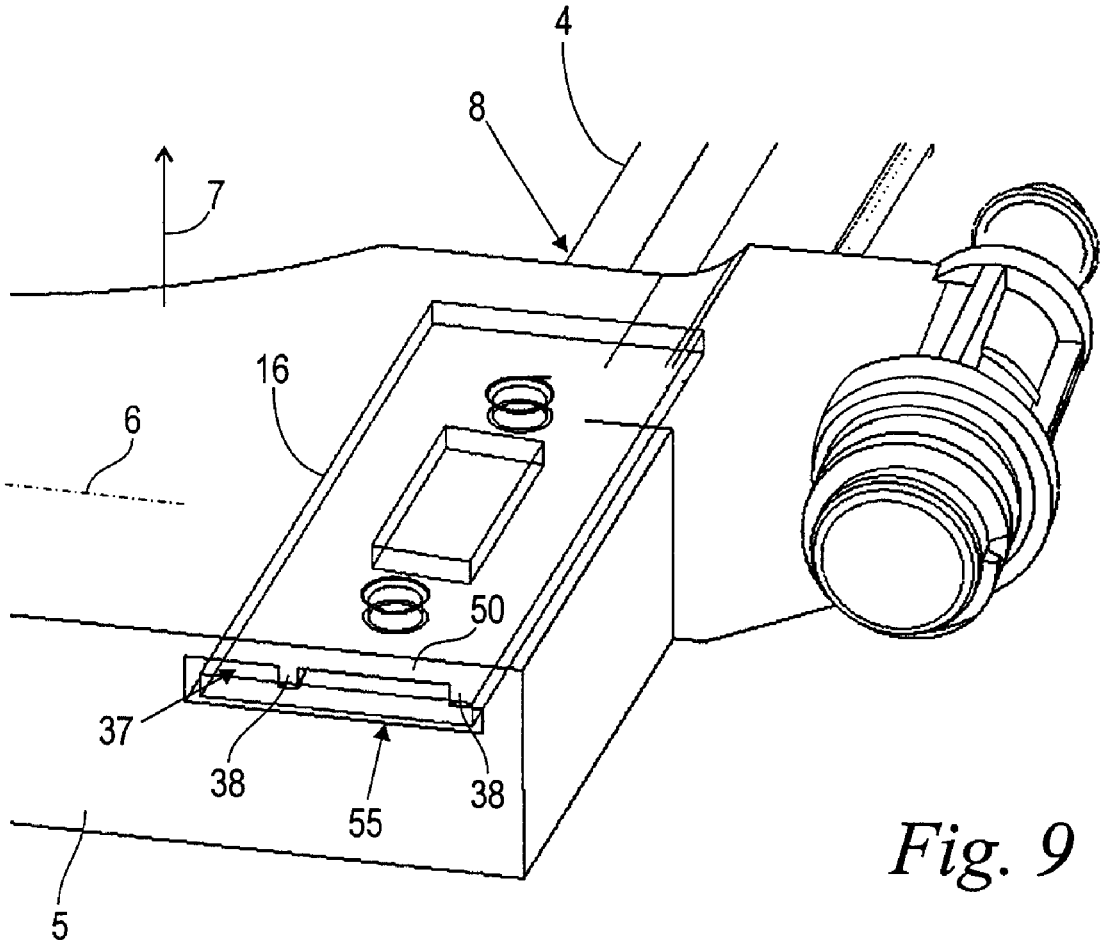
FIG. 9 shows a variant of the arrangement of FIG. 5 with an insertion sheet metal part according to FIG. 4 having been inserted and clamped.

FIG. 9 shows an alternative configuration of the arrangement of FIG. 5 in which the longitudinal support 5 in the area of the connecting end 8 of the grip pipe 4 is provided with a pocket-shaped receptacle 37. The pocket-shaped receptacle 37 is open in the transverse direction that is perpendicular to the longitudinal axis 6 and to the vertical direction 7 so that the insertion sheet metal plate 16 illustrated in FIG. 4 and only schematically shown in FIG. 9 is inserted laterally into the pocket-shaped receptacle 37. The pocket-shaped receptacle 37 in the vertical direction 7 is delimited upwardly by the cover surface 50 and downwardly by the bottom 55 (not illustrated in detail). The insertion sheet metal plate 16 has in the lateral direction a smaller extension than the longitudinal support 5 and can therefore be inserted into the pocket-shaped receptacle 37 so far that it does not project in the two lateral directions. The insertion sheet metal plate 16, like the insertion part of the preceding embodiment, is received within the longitudinal support 5 made of plastic material so as to be completely arranged within the contour of the longitudinal support 5. In all embodiments it can also be expedient that the insertion parts 11 shown in FIGS. 3 and 4 project in the lateral direction past the contour of the longitudinal support 5 but not in the vertical direction 7.

For positional fixation of the insertion sheet metal plate 16 the pocket-shaped receptacle 37 is provided with two clamping ribs 38 that project from the cover surface 50 inwardly into the pocket-shaped receptacle 37 and extend lengthwise in the transverse direction; the insertion sheet metal plate 16 can be secured by a clamping action between the clamping ribs 38 and the oppositely positioned bottom 55.

Alternatively or additionally, aside from the clamping fixation of the insertion parts shown in FIG. 3 and FIG. 4, a snap-on or a locking attachment or also an integration of the insertion parts by injection molding into the plastic material of the longitudinal support 5 can be expedient.

In the embodiment according to FIG. 9, the screw connection of the connecting end 8 with the insertion sheet metal plate 16 can be realized in analogy to the preceding embodiment wherein however the connecting end 8 is not directly in contact with the insertion sheet metal plate 16 but is pressed against the bottom 55. In regard to the other features and reference numerals, the embodiment of FIG. 9 is identical to that of FIGS. 2 through 8.

While specific embodiments of the invention have been shown and described in detail to illustrate the inventive principles, it will be understood that the invention may be embodied otherwise without departing from such principles.

What is claimed is:

1. A hand-held power tool comprising:

a motor housing in which a drive motor is arranged;

a grip housing comprising a longitudinal support, wherein the motor housing and the grip housing are connected to one another by antivibration elements;

a forward grip pipe that, in a normal operating position of the power tool, is remote from an operator;

wherein the forward grip pipe has a connecting end and the connecting end is connected by a screw connection to the longitudinal support;

wherein the screw connection comprises at least one fastening screw that is positioned in the normal operating position of the power tool substantially in a vertical direction of the power tool;

wherein the screw connection comprises a metal insertion part that is positioned entirely within a contour of the longitudinal support, wherein the longitudinal support is a plastic part;

wherein the metal insertion part has a screw receptacle and the at least one fastening screw is fixedly screwed into the screw receptade that is a threaded bore matched to an outer thread of the at least one fastening screw;

wherein the insertion part is a spring bracket having a first spring leg and a second spring leg, wherein the longitudinal support has an inner mounting rib and wherein the first and second spring legs engage by a clamping action on opposite sides of the inner mounting rib; and wherein the grip housing and the forward grip pipe form a rigid unit in that the forward grip pipe is fixedly screwed onto the grip housing without an antivibration element being interposed therebetween.

2. The power tool according to claim 1, wherein the outer thread of the at least one fastening screw is a metric thread.

3. The power tool according to claim 1, wherein the spring bracket consists of spring steel.

4. The power tool according to claim 1, wherein the screw connection comprises several of said spring bracket each receiving one of the at least one fastening screw.

5. The power tool according to claim 1, wherein the spring bracket is a sheet metal part and the screw receptacle is a sleeve-shaped monolithic part of the sheet metal part.

6. The power tool according to claim 5, wherein the first and second legs have first ends connected by a bottom section so that the spring bracket is U-shaped, wherein a width of the bottom section measured between the first and second legs is greater than a thickness of the inner mounting rib, and wherein the first and second spring legs converge in a direction away from the bottom section.

7. The power tool according to claim 5, wherein at least one of the first and second spring legs has a mounting ramp for spreading apart the first and second spring legs when pushed onto the inner mounting rib.

8. The power tool according to claim 5, wherein the connecting end of the forward grip pipe rests flat against the first spring leg and wherein the second spring leg is provided with the screw receptacle.

9. The power tool according to claim 8, wherein the second spring leg is comprised of two spring strips and a contact section, wherein the contact section is arranged between the two spring strips and has a spring action independent of the two spring strips, wherein the screw receptacle is arranged on the contact section, and wherein the contact section extends approximately parallel to the first spring leg.

* * * * *